US010695786B2

(12) United States Patent
Mercado

(10) Patent No.: US 10,695,786 B2
(45) Date of Patent: Jun. 30, 2020

(54) HAND-HELD SHOWER HEAD SYSTEM

(71) Applicant: Carlos Mercado, New Braunfels, TX (US)

(72) Inventor: Carlos Mercado, New Braunfels, TX (US)

( * ) Notice: Subject to any disclaimer, the term of this patent is extended or adjusted under 35 U.S.C. 154(b) by 0 days.

(21) Appl. No.: 16/143,756

(22) Filed: Sep. 27, 2018

(65) Prior Publication Data

US 2019/0091715 A1 Mar. 28, 2019

Related U.S. Application Data

(63) Continuation-in-part of application No. 29/663,443, filed on Sep. 14, 2018, now Pat. No. Des. 870,847.

(60) Provisional application No. 62/564,048, filed on Sep. 27, 2017.

(51) Int. Cl.

| | |
|---|---|
| ***B05B 15/63*** | (2018.01) |
| ***B05B 1/18*** | (2006.01) |
| ***B05B 15/62*** | (2018.01) |
| ***E03C 1/04*** | (2006.01) |

(52) U.S. Cl.

CPC ..... *B05B 15/63* (2018.02); *B05B 1/18* (2013.01); *B05B 1/185* (2013.01); *B05B 15/62* (2018.02); *E03C 1/0408* (2013.01)

(58) Field of Classification Search

CPC ..... B05B 15/63; B05B 15/62
USPC ..... 4/615
See application file for complete search history.

(56) References Cited

U.S. PATENT DOCUMENTS

| | | | | |
|---|---|---|---|---|
| 7,900,295 | B2 * | 3/2011 | Lev | B05B 1/1672 4/615 |
| 2010/0043135 | A1 * | 2/2010 | Patterson | E03C 1/06 4/612 |
| 2015/0090812 | A1 * | 4/2015 | Wu | E03C 1/0409 239/446 |

* cited by examiner

*Primary Examiner* — Lauren A Crane

(57) ABSTRACT

A hand-held shower head system configured to dispense a fluid is disclosed. The hand-held shower head system may include a housing configured to be secured to a surface. Further, the hand-held shower system may include a shower head configured to be detachably mounted on the housing. Further, the hand-held shower system may include a plurality of hoses connected to the shower head. Further, a plurality of first openings of the plurality of hoses may be configured to be connected to a plurality of fluid supply lines. Further, the hand-held shower system may include a retracting mechanism coupled to the shower head and the housing. Further, the retracting mechanism may be configured to allow the shower head to be retracted back to the housing once the user releases the shower head.

4 Claims, 13 Drawing Sheets

HAND-HELD SHOWER HEAD SYSTEM

FIELD OF THE INVENTION

The present invention relates generally to shower accessories and bathroom accessories. More specifically, the present invention relates to retractable shower heads.

BACKGROUND OF THE INVENTION

Shower heads are commonly found on residential bathrooms. In general, shower heads are small nozzles with an ornamental design which may or may not match the design of the shower in the bathroom. Shower heads are often positioned at an elevated position on a wall inside the shower. The shower head is connected to the plumbing inside the wall of the shower which is connected to a valve which the user can freely open or close to allow water to flow out of the shower head. Most traditional shower heads are permanently attached to the wall and can be pivoted around a joint to allow the user to position the shower head at different angles. This traditional setup is efficient for the purpose of allowing the user to take a shower. But, this traditional setup does not provide a way to allow the user to water different areas of the body freely. Newer shower heads come with an additional elongated hose attached to the shower head at one end and attached to the plumbing at the other end. The shower head is then held from a holder attached to the wall of the shower at a distance from the ground. This way, the user can use the shower head traditionally or detach it from the holder and use the shower head hand-held. Now, while this newer setup provides more flexibility to the user while showering, the elongated hose can be inconvenient and unstylish. To address this issue, some new shower heads which are retractable have the elongated, retractable hose housed inside the walls. However, to install this retractable head shower, the user has to change and modify the structure of the shower. Therefore, a retractable shower head which is easy to install, does not require to modify the structure of the shower, and does not obstruct the space of the user inside the shower is beneficial and necessary.

Therefore, there is a need for improved hand held shower head system that may overcome one or more of the above-mentioned problems and/or limitations.

SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

According to some embodiments, a hand-held shower head system configured to dispense a fluid is disclosed. The hand-held shower head system may include a housing configured to be secured to a surface. Further, the hand-held shower system may include a shower head configured to be detachably mounted on the housing. Further, the hand-held shower system may include a plurality of hoses connected to the shower head. Further, a plurality of first openings of the plurality of hoses may be configured to be connected to a plurality of fluid supply lines. Further, the hand-held shower system may include a retracting mechanism coupled to the shower head and the housing. Further, the retracting mechanism may be configured to allow the shower head to be retracted back to the housing once the user releases the shower head.

According to some embodiments, a hand-held shower head system configured to dispense a fluid is also disclosed. The hand-held shower head system may include a housing configured to be secured to a surface. Further, the hand-held shower system may include a shower head configured to be detachably mounted on the housing. Further, the shower head further may include a magnetic coupling mechanism configured to detachably couple the shower head to the housing. Further, the hand-held shower system may include at least one hose connected to the shower head. Further, at least one first opening of the at least one hose may be configured to be connected to at least one fluid supply line. Further, the hand-held shower system may include a retracting mechanism coupled to the shower head and the housing. Further, the retracting mechanism may be configured to allow the shower head to be retracted back to the housing once the user releases the shower head. Further, the at least one hose may be configured to be disposed within the housing while the shower head may be retracted back to the housing.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
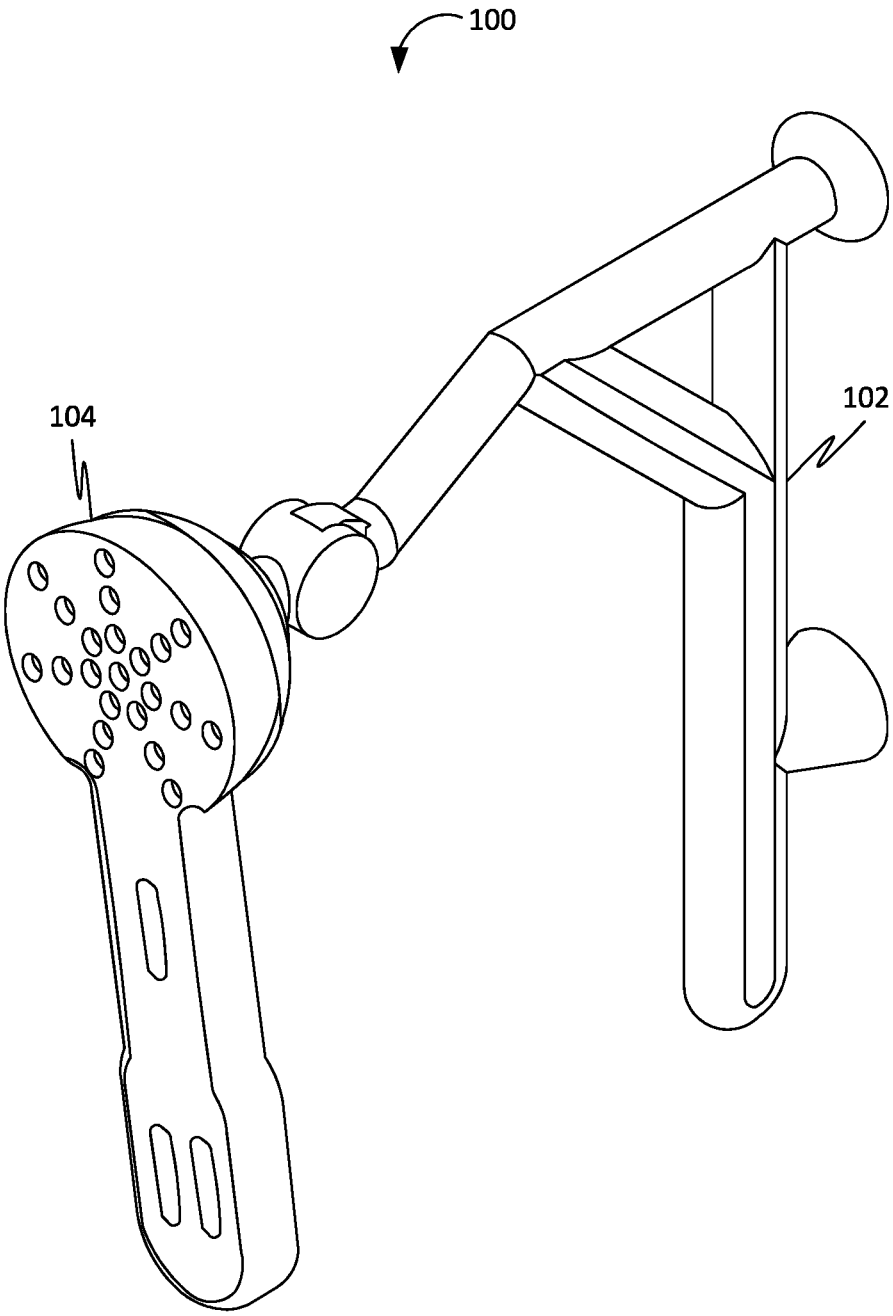
FIG. 1 is a perspective view of the present invention showing the hand-held shower head system with the head attached to the housing, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

Overview:

An objective of the present invention is to provide a hand-held shower head system which provides a shower head which can be used as a hand-held shower head or traditional shower head. Another objective of the present invention is to provide a hand-held shower head system which provides a shower head which is retractable. Another objective of the present invention is to provide a hand-held shower head system which provides a retractable system which is enclosed within a housing. Another objective of the present invention is to provide a hand-held shower head system which is easily installed and does not require the user to change or modify the shower's structure. Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

According to some embodiments, a hand-held shower head system comprising a head, a housing, and a plurality of hoses may be disclosed.

Further, the head of the hand-held shower head system may comprise a body, an upper portion, and a lower portion, Further, the upper portion of the head may comprise a front and a back. Further, the front of the upper portion further may comprise a plurality of orifices, and the back of the upper portion further may comprise a plurality of magnets and one or more inlets. Further, the one or more orifices will allow one or more fluids to flow out of the head, and the one or more inlets may be configured to, and may receive one or more hoses carrying one or more fluids, Further, the one or more inlets may be configured to receive the one or more fluids from the one or more hoses and guide the one or more fluids to the plurality of orifices. Further, the lower portion of the head further may comprise a handle, Further, the handle may be a long extension of the lower portion which may allow the body of the head to be gripped a housing, Further, the back of the upper portion of the head may comprise a plurality of magnets, Further, the plurality of allow the head to interface to the one or more receivers, and remain secured while the system may be in the retracted state.

Further, the lower portion of the head may include a plurality of controls, Further, the plurality of controls may communicate with one or more components of the hand-held shower head system to control flow conditions corresponding to one or more fluids received from the one or more hoses. Further, the flow conditions corresponding to the one or more fluids may include at least one of flow volume, flow speed, flow pattern, flow pressure, and flow temperature.

Further, the housing further may comprise a body, an upper portion, a lower portion, and an arm. Further, the upper portion of the body of the housing may be a hollow tubular portion with a first end and a second end, and a first portion and a second portion. Further, the first portion of the upper portion may correspond to the first end of the upper portion, and comprise a connector which may be configured to attach the body of the housing to a surface, and the first end of the upper portion may be connected to a plumbing outlet. Further, the second portion may comprise one or more connectors, and may correspond to the second end, and may connect to the arm of the housing. Further, the lower portion of the housing may comprise a plurality of connectors and a retracting mechanism; Further, the plurality of connectors may allow the body of the housing to be configured to the surface. Further, the retracting mechanism may allow the plurality of hoses positioned inside the body of the housing to be pulled out of the body of the housing when the head of the hand-held shower head system may be detached, and allow the plurality of hoses to be pulled back into the body of the housing once the head may be released using counterweight system or any such mechanism. Further, the arm of the housing may comprise a hollow portion, a first end, a second end, one or more receivers, and one or more joints. Further, the hollow portion of the arm may be connected to the second end of the upper portion of the body of the housing along the first end; Further, the second end of the arm may include a one or more joints connecting the hollow portion of the arm to one or more receivers, Further, the one or more receivers may be configured so as to receive the head of the hand-held shower head system.

Further, the plurality of hoses may include a first end, and a second end. Further, the first end may interface with a plurality of plumbing outlets to receive a plurality of fluids from the plurality of plumbing outlets. Further, the second end may be connected to the one or more inlets of the upper portion of the head. Further, the plurality of hoses may carry the one or more fluids from the first end to the second i.e. from the plurality of plumbing outlets to the one or more inlets of the upper portion of the head. Further, the plurality of hoses may be retractable, in that the hoses may expand longitudinally upon exertion of a pulling force, and may retract upon removal of the pulling force.

Further, the system may include an extended state, and a retracted state. Further, the extended state may correspond to the plurality of hoses expanded upon exertion of a pulling force, along with the head detached from the one or more receivers. Further, the retracted state may correspond to the plurality of hoses retracted upon removal of the pulling force, along with the head attached to the one or more receivers. Further, the extended state allows the system to be used in an elongated state to dispense one or more liquids at a plurality of angles and locations by movement; Further, the retracted state allows the system to be used in a fixed state to dispense one or more fluids at a fixed location at a particular angle.

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of providing a hand held shower head, embodiments of the present disclosure are not limited to use only in this context.

All illustrations of the drawings are for the purpose of describing selected versions of the present invention and are not intended to limit the scope of the present invention.

Figure 6:
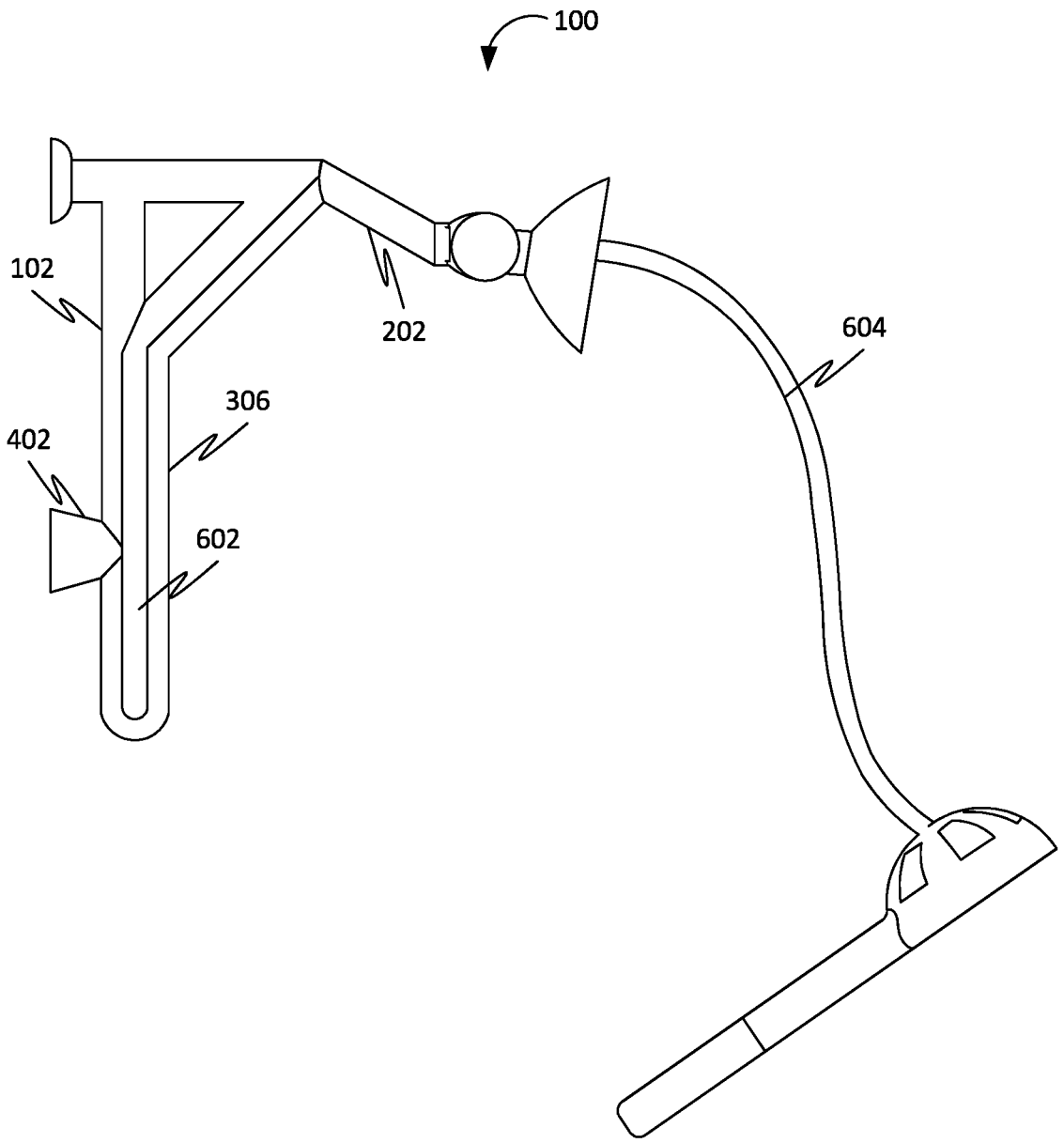
FIG. 6 is a side view of the present invention showing the head detached from the housing, in accordance with some embodiments.

As shown in FIG. 1 a hand-held shower head system 100 configured to dispense a fluid is disclosed. The hand-held shower head system 100 may include a housing 102 configured to be secured to a surface. Further, the hand-held shower system 100 may include a shower head 104 configured to be detachably mounted on the housing 102. Further, as shown in FIG. 6 the hand-held shower system may include a plurality of hoses 604 connected to the shower head 104. Further, a plurality of first openings of the plurality of hoses 604 may be configured to be connected to a plurality of fluid supply lines. Further, the hand-held shower system may include a retracting mechanism coupled to the shower head 104 and the housing 102. Further, the retracting mechanism may be configured to allow the shower head 104 to be retracted back to the housing 102 once the user releases the shower head 104.

In some embodiments, the plurality of hoses 604 may be configured to be connected to a wall pipe system.

In some embodiments, the shower head 104 further may include a controlling mechanism configured to control at least one flow property of a fluid dispensed from the shower head 104. In some embodiments, the controlling mechanism may include one or more of a mechanical control and an electrical control. In some embodiments, the at least one flow property of the fluid may include flow volume, speed, pattern and temperature.

Figure 3:
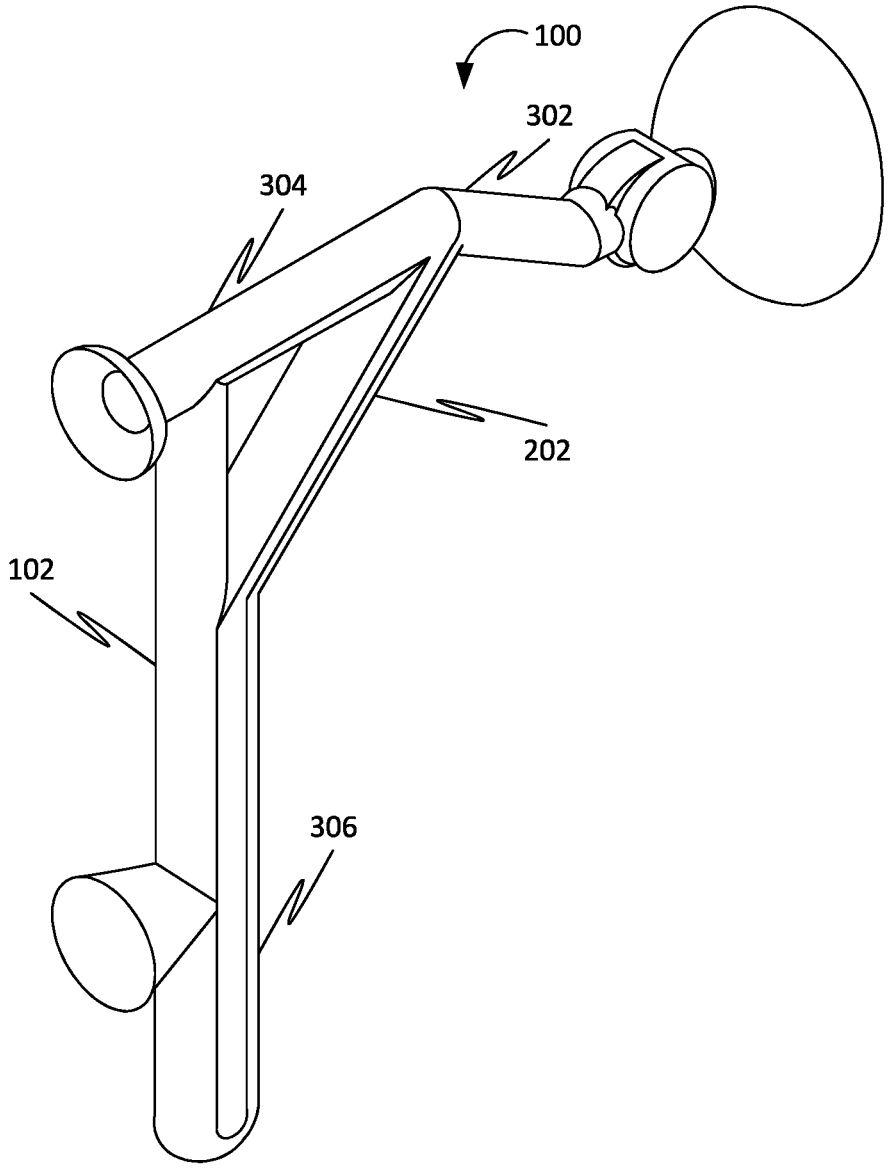
FIG. 3 is a perspective view of the present invention showing the housing of the hand-held shower head system, in accordance with some embodiments.
Figure 4:
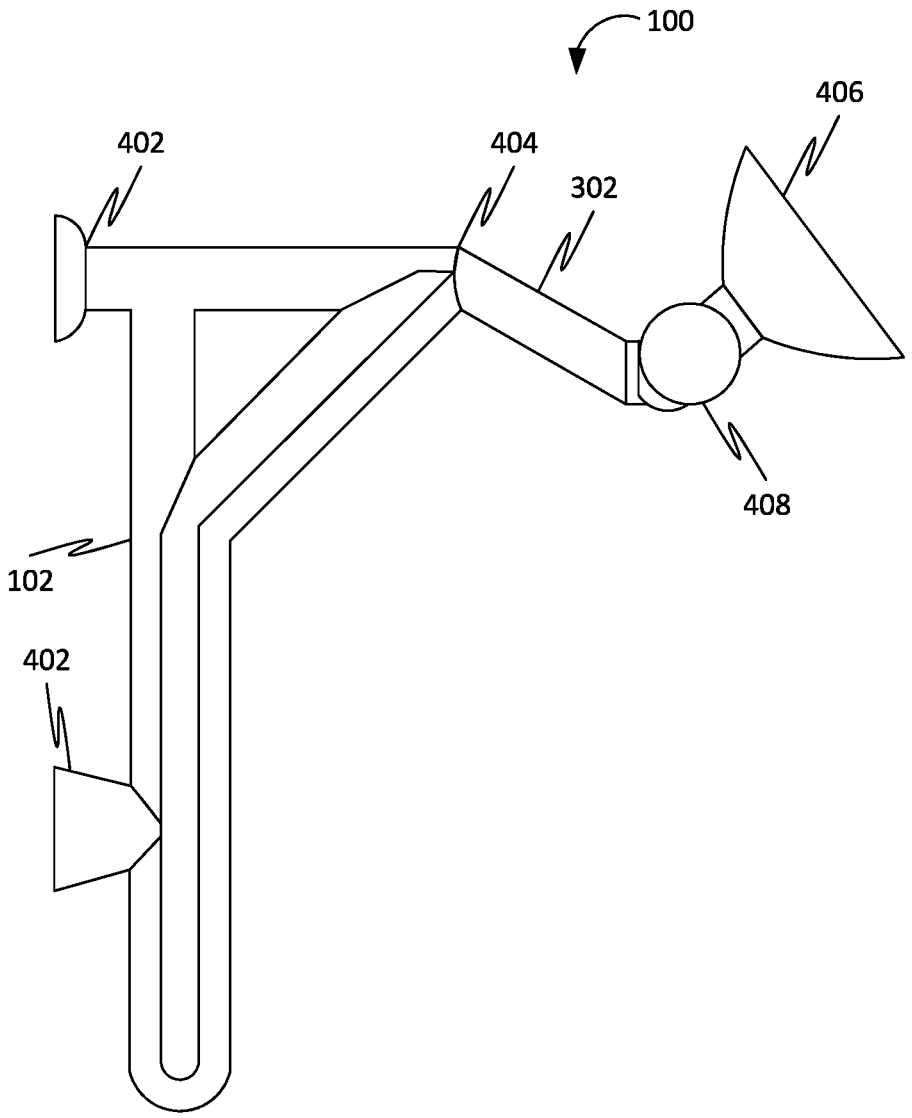
FIG. 4 is a side view of the present invention showing a receiver rotated around a joint, in accordance with some embodiments.

In some embodiments, as shown in FIG. 3, the housing 102 may include an upper portion 304 and a lower portion 306. Further, as shown in FIG. 4, the upper portion 304 may include one or more connectors 402 configured to connect the housing 102 to an existing plumbing of a shower. Further, the lower portion 306 may include a plurality of connectors 402 configured to secure the housing 102 to the surface of the shower.

Figure 9:
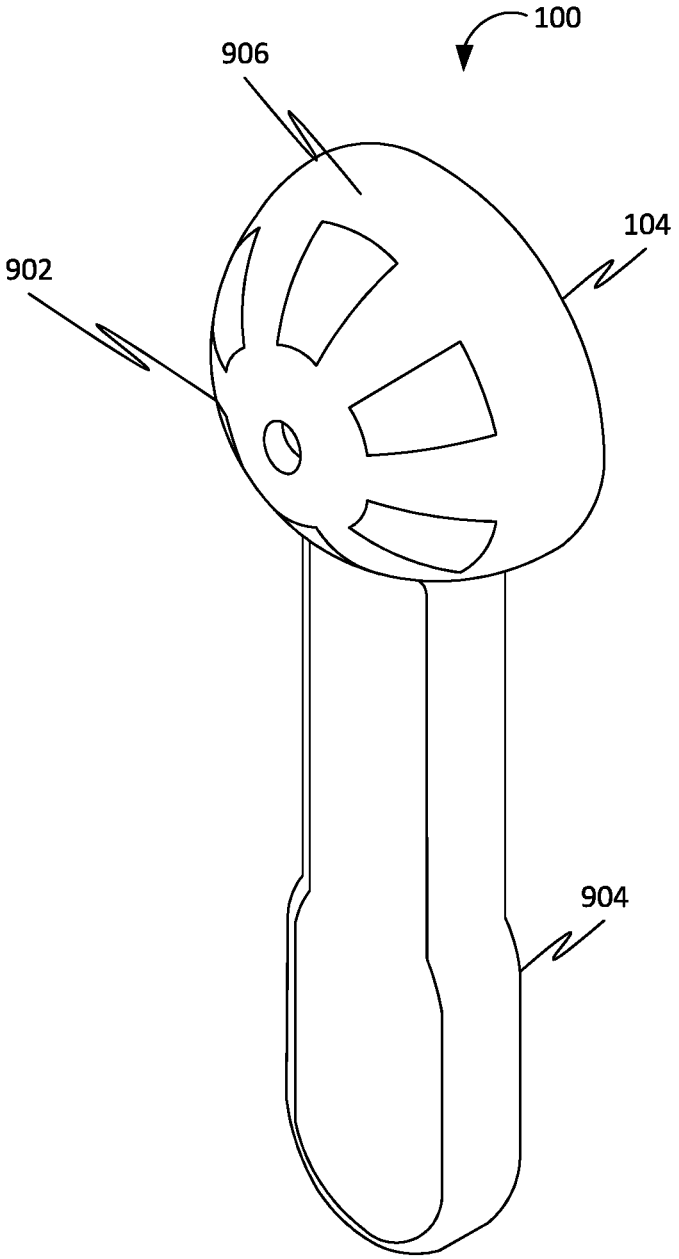
FIG. 9 is a perspective view of the present invention showing a plurality of magnets attached to the back of the upper portion of the head, in accordance with some embodiments.
Figure 10:
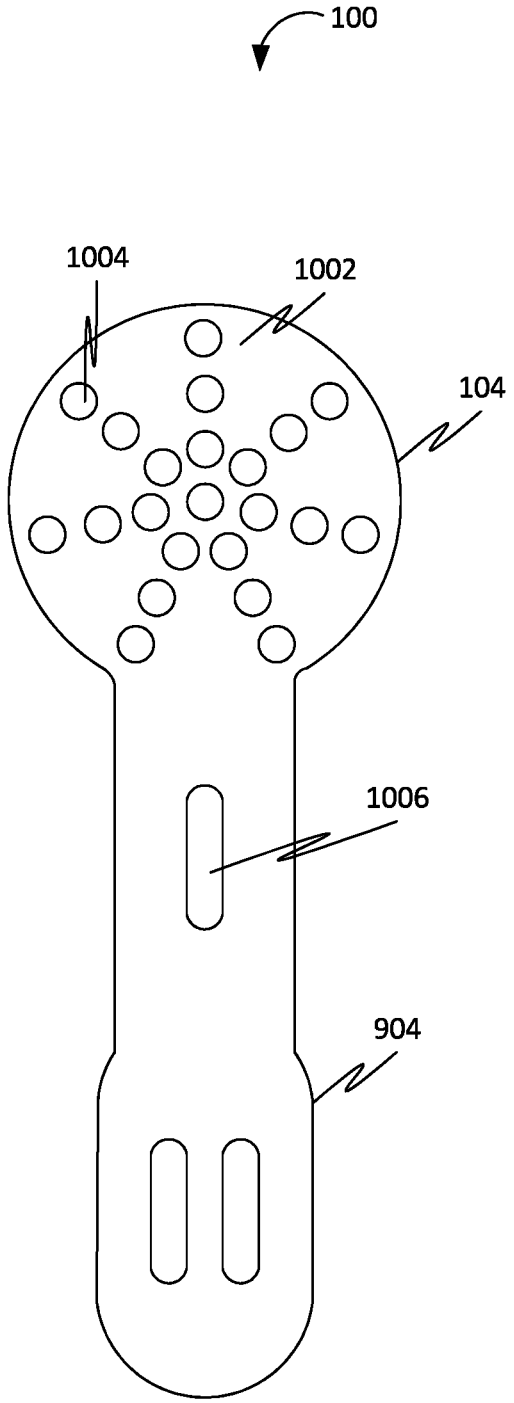
FIG. 10 is a front view of the present invention showing a plurality of orifices, in accordance with some embodiments.

In some embodiments, the shower head 104 may include a body, an upper portion 304, and a lower portion 306. Further, as shown in FIG. 9 and FIG. 10 the upper portion 304 of the shower head 104 may include a front 1002 and a back 906. Further, as shown in FIG. 10 the front of the upper portion 304 of the shower head 104 may include a plurality of orifices 1004 configured to dispense the fluid.

Figure 11:
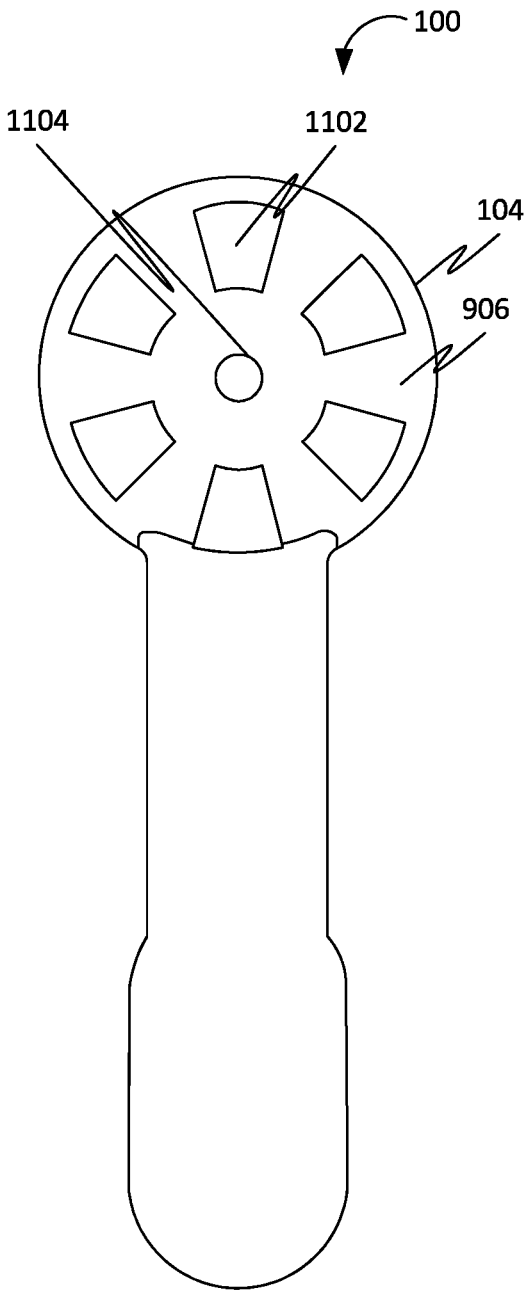
FIG. 11 is a back view of the present invention showing an inlet, in accordance with some embodiments.

Further, as shown in FIG. 11 the back of the upper portion 304 of the shower head 104 may include a coupling mechanism configured to detachably couple the shower head 104 to the housing 102 and one or more inlets 1104 configured to be connected with a plurality of second openings of the plurality of hoses 604. In some embodiments, the coupling mechanism may include at least one magnetic material 1102 disposed on one or more of the upper portion 304 of the shower head 104 and the housing 102. In some embodiments, the at least one magnetic material may include a plurality of magnets arranged in a circular pattern around the back surface of the upper portion 304 of the shower head 104.

In some embodiments, as shown in FIG. 10 the lower portion 306 of the shower head 104 further may include a handle and at least one control 1006 configured to control at least one flow property of the fluid dispensed from the shower head 104.

In some embodiments, the lower portion 306 of the shower head 104 further may include a handle configured to be grabbed by a human hand.

In some embodiments, the handle further may include a at least one control 1006 configured to control at least one flow property of a fluid dispensed from the shower head 104.

In some embodiments, the at least one control may be positioned around a front surface 1002 of the lower portion 306.

In some embodiments, the upper portion 304 of the body of the shower head 104 may include a control mechanism configured to allow a user to change flow pressure and amount of flow corresponding to the dispensing of the fluid.

In some embodiments, the housing 102 may include a body, an arm, an upper portion 304, and a lower portion 306.

Further, as shown in FIG. 4, in some embodiments, the arm of the housing 102 may include one or more receivers 406 and one or more joints 408.

In some embodiments, the upper portion 304 of the housing 102 further may include a first portion and a second portion. Further, the second portion of the upper portion 304 may include one or more connectors. Further, the lower portion 306 of the housing 102 may include the plurality of connectors and the retracting mechanism.

In some embodiments, the plurality of hoses 604 may be configured to be disposed within the housing 102 while the shower head 104 may be retracted back to the housing 102.

A hand-held shower head system 100 configured to dispense a fluid is also disclosed. The hand-held shower head system 100 may include a housing 102 configured to be secured to a surface. Further, the hand-held shower system 100 may include a shower head 104 configured to be detachably mounted on the housing 102. Further, the shower head 104 may include a magnetic coupling mechanism configured to detachably couple the shower head 104 to the housing 102. Further, the hand-held shower system may include at least one hose, such as the hose 604 connected to the shower head 104. Further, at least one first opening of the at least one hose 604 may be configured to be connected to at least one fluid supply line. Further, the hand-held shower system may include a retracting mechanism coupled to the shower head 104 and the housing 102. Further, the retracting mechanism may be configured to allow the shower head 104 to be retracted back to the housing 102 once the user releases the shower head 104. Further, the at least one hose 604 may be configured to be disposed within the housing 102 while the shower head 104 may be retracted back to the housing 102. In some embodiments, the shower head 104 further may include a controlling mechanism configured to control at least one flow property of a fluid dispensed from the shower head 104.

In an embodiment, the present disclosure may describe a hand-held shower head system. The hand-held shower head system may provide a shower head which may be used as a traditional shower head or a hand-held shower head. The hand-held shower head system may further provide a retracting mechanism which may allow the shower head to be retracted back to the housing once the head is released. In a preferred embodiment of the present invention, the hand-held shower head system may comprise a head, a housing, and a plurality of hoses. The head of the hand-held shower head system may further comprise a body, an upper portion, and a lower portion. The upper portion of the head may further comprise a front and a back. The front of the upper portion may further comprise a plurality of orifices. The back of the upper portion may further comprise a plurality of magnets and one or more inlets. The lower portion of the head may further comprise a handle and a plurality of controls. The housing of the hand-held shower head system may further comprise a body, an arm, an upper portion, and a lower portion. The arm of the housing may further comprise one or more receivers and one or more joints. The upper portion of the housing may further comprise a first portion and a second portion. The second portion of the upper portion may further comprise one or more connectors. The lower portion of the housing may further comprise a plurality of connectors and a retracting mechanism.

Figure 2:
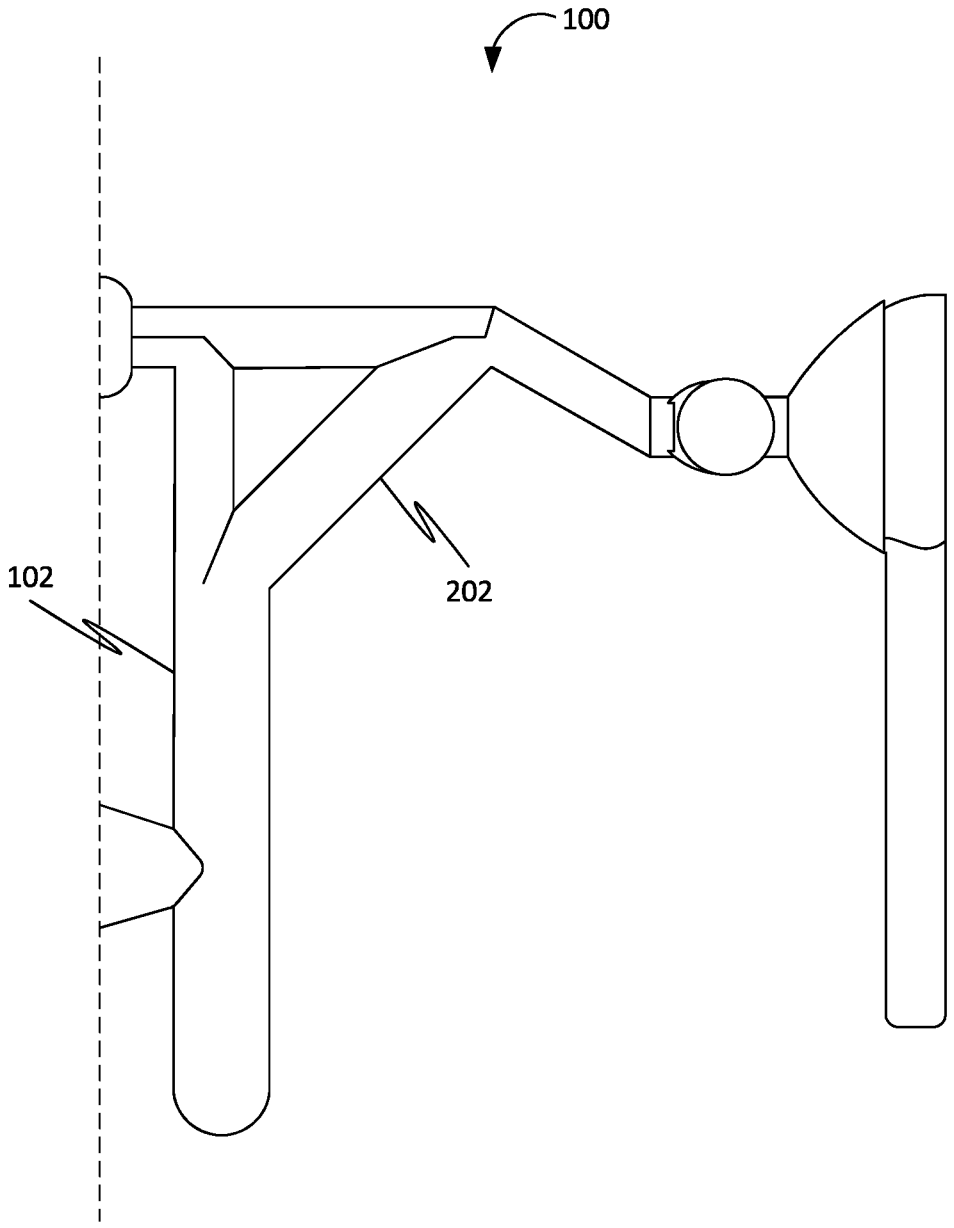
FIG. 2 is a side view of the present invention, in accordance with some embodiments.
Figure 5:
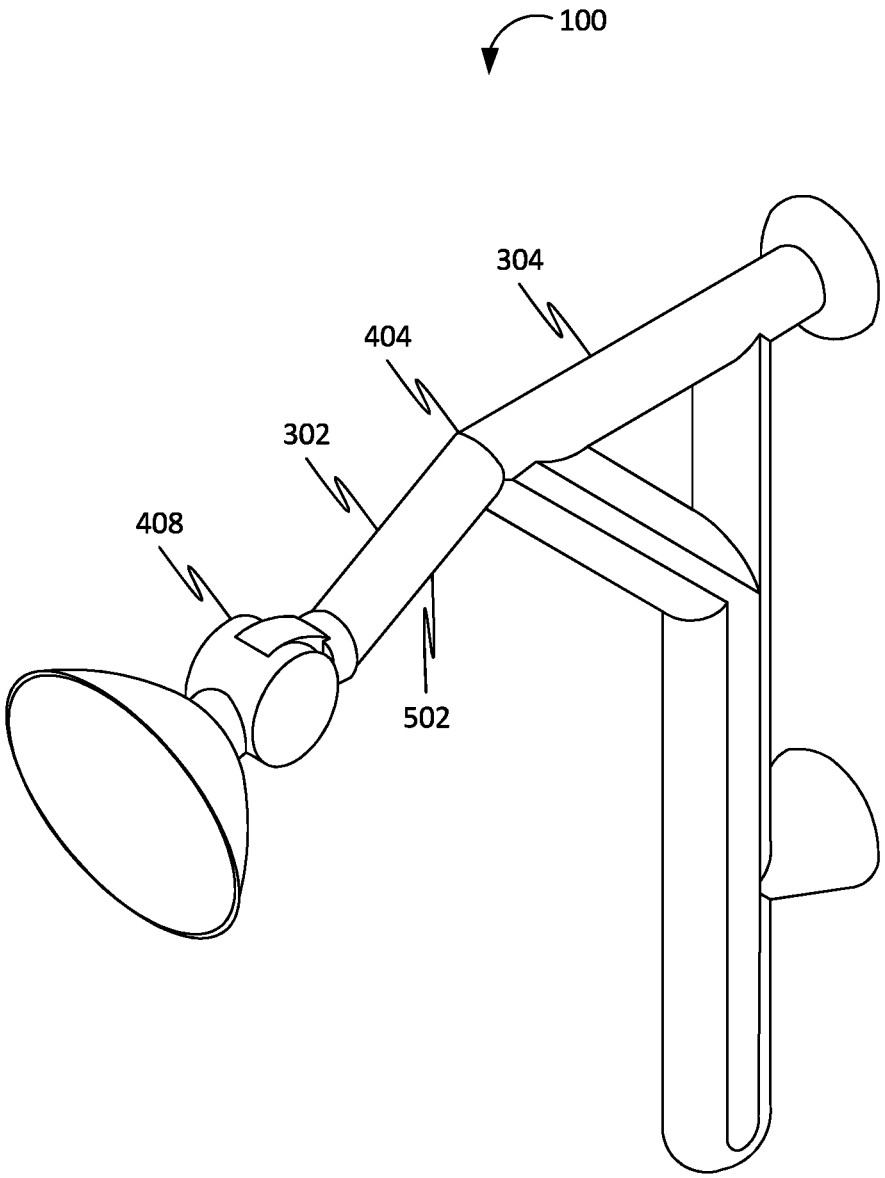
FIG. 5 is a perspective view of the present invention showing the housing of the hand-held shower head system, in accordance with some embodiments.
Figure 7:
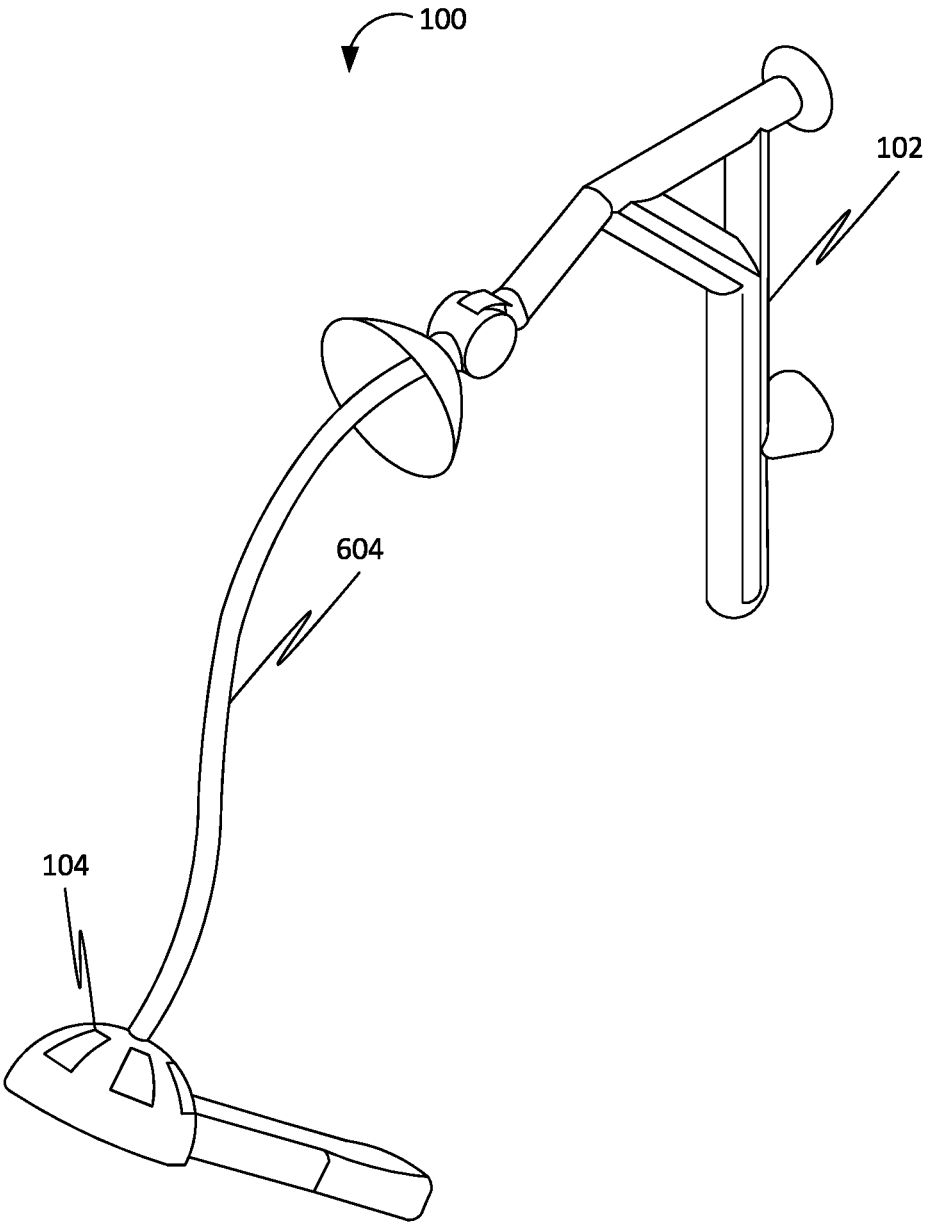
FIG. 7 is a perspective view of the present invention showing the plurality of hoses connected to the head, in accordance with some embodiments.

As shown in FIG. 1, the hand-held shower head 104 system 100 may comprise a housing 102. The housing 102 of the hand-held shower head 104 system may hold a head 104 and the plurality of hoses 604. As can be seen in FIG. 2, the housing 102 may comprise a body 202. The body 202 of the housing 102 is a hollow structure which may be attached to a surface to hold the weight of the head 104 as well as the plurality of hoses 604 stored inside the body 202 of the housing 102. As can be seen in FIG. 3, the body 202 of the housing 102 may comprise an arm 302, an upper portion 304, and a lower portion 306. As can be seen in FIG. 4, the upper portion of the body 202 of the housing 102 is a hollow tubular portion with a first end 402 and a second end 404. The first end 402 of the upper portion 304 may be connected to outlet plumbing configured to of the shower. As can be seen in FIG. 4, the lower portion 306 may connect to the upper portion 304. As can be seen in FIG. 4, the arm 302 of the housing 102 is attached to the second end 404 of the upper portion 304. In the preferred embodiment of the present invention, the upper portion 304 of the housing 102 may further comprise a first portion and a second portion. The first portion of the upper portion 304 may further comprise a connector which attaches the body 202 of the housing 102 to a surface. Further, the arm 302 of the housing 102 may comprise one or more receivers, such as the receiver 406, and one or more joints, such as the joint 408. As can be seen in FIG. 5, the arm 302 may comprise a hollow portion 502 connected to the second end 404 of the upper portion 304. In an embodiment, the joint may be a hollow joint that may allow the receiver to be rotated around at different angles around the joint. Further, the receiver may match in shape and dimension to the head 104 (not shown in FIG. 5). As can be seen in FIG. 6, the lower portion 306 may comprise a plurality of connectors, such as the connector and a retracting mechanism 602. In the preferred embodiment of the present invention, the plurality of connectors may allow the body 202 of the housing 102 to be attached to a surface. The retracting mechanism 602 may allow the plurality of hoses 604, such as the hose 604 positioned inside the housing 102 to be pulled out of the housing 102 when the head 104 is detached, as can be seen in FIG. 7. The retracting mechanism 602 further allows the plurality of hoses 604 to be pulled back into the body 202 of the housing 102 once the user lets go of the head 104, as can be seen in FIG. 6. In an embodiment, the retracting mechanism 602 may include a counterweight system. In alternate embodiments, the retracting mechanism 602 may comprise a different mechanism such as a recoil mechanism or similar mechanism.

Figure 8:
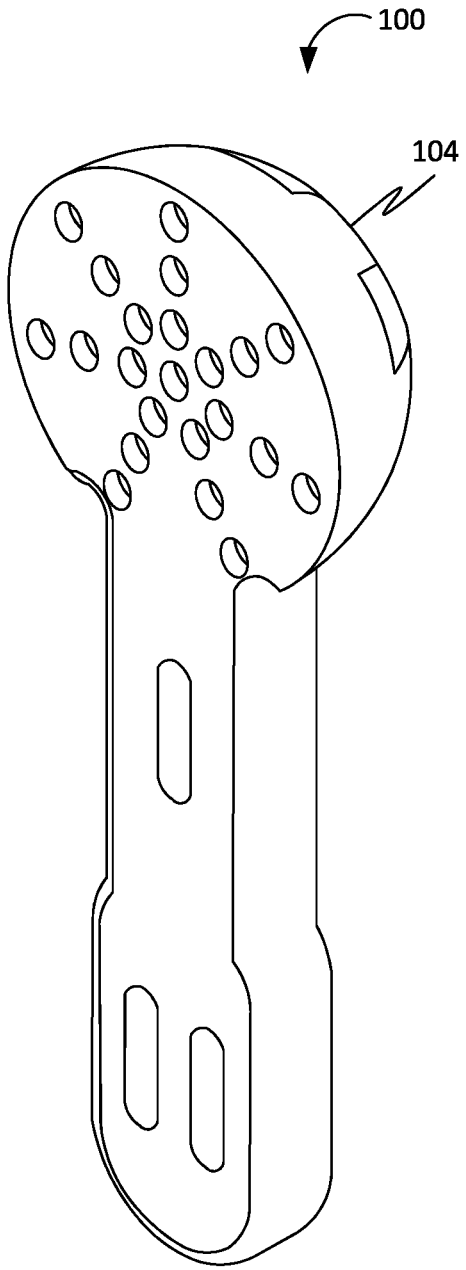
FIG. 8 is a perspective view of the present invention showing a plurality of controls, in accordance with some embodiments.

As shown in FIG. 7 the head 104 of the hand-held shower head 104 system 100 may be used as a hand held shower head 104 in an extended state in addition to a traditional shower head 104, as shown in FIG. 1, and also as a hand-held shower head 104. As can be seen in FIG. 8, the head 104 may comprise an ornamental design that may be held by a hand of a user and may be easily controllable. Further, as shown in FIG. 9 the head 104 may comprise an upper portion 902 and a lower portion 904. Further, the upper portion 902 of the head 104 may comprise a front surface (not shown in FIG. 9) and a back surface 906. As can be seen in FIG. 10, the front surface 1002 of the upper portion 902 may comprise a plurality of orifices 1004. In an embodiment, the plurality of orifices 1004 may be arranged in a circular pattern along the front surface 1002 to allow the water flow out of the plurality of hoses 604. As can be seen in FIG. 10, lower portion 904 may comprise a handle, which may be a long section of the lower portion 904 to the user to easily grab the head 104. Further, a plurality of controls 1006 may be positioned around the front surface 1002 of the lower portion 904. In the preferred embodiment of the present invention, the plurality of controls 1006 may allow the user to control the flow conditions such as, but not limited to, the water flow volume, speed, pattern, temperature, etc. In an embodiment, the upper portion 902 of the head 104 may further comprise a control mechanism which may allow the user to change the flow pressure as well the amount of water flow and other similar water flow properties. The plurality of controls 1006 may be mechanical or electrical. In alternate embodiments of the present invention, an additional number of components is further positioned inside the head 104. As can be seen in FIG. 11, the back surface 906 of the upper portion 902 may further comprise a plurality of magnets and one or more inlets 1104. The plurality of magnets 1102 may be arranged in a circular pattern around the back surface 906 and may allow the head 104 to be safely secured to the one or more receiver of the arm 302 of the housing 102.

Figure 12:
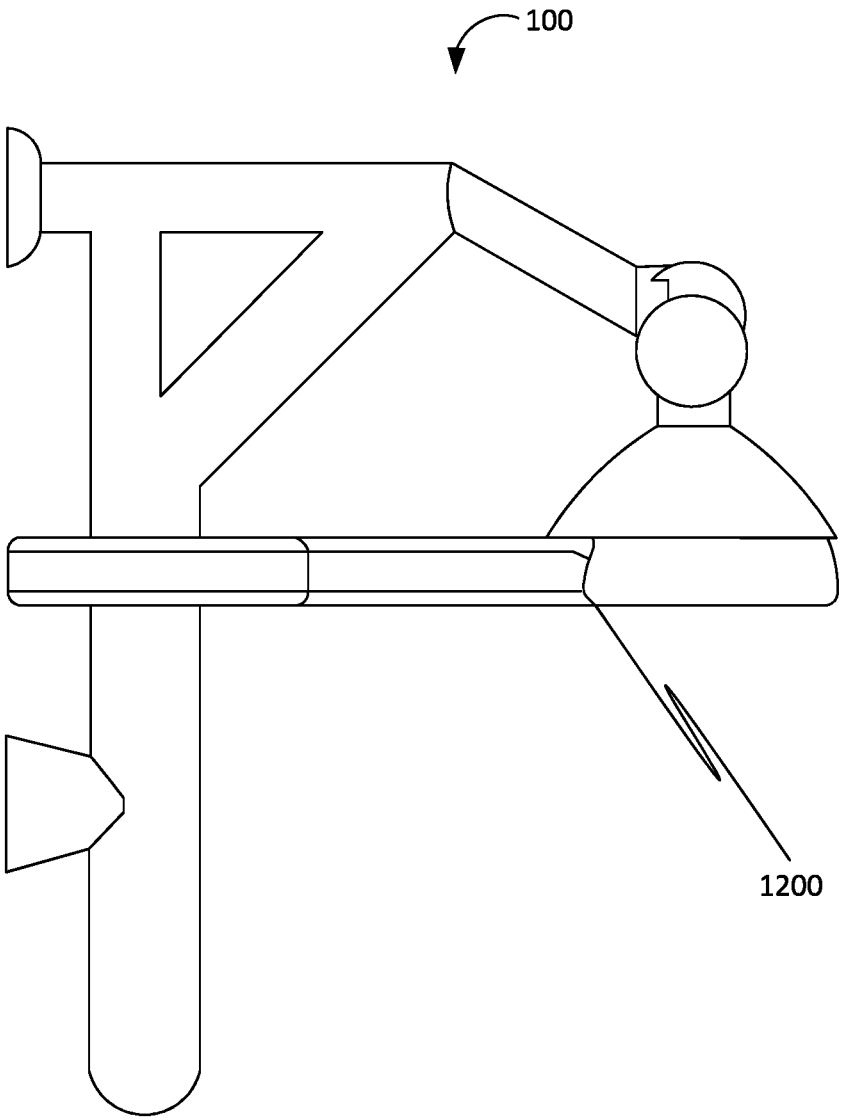
FIG. 12 is a side view of the present invention showing the lower portion of the body of the head is attached to the lower portion of the body of the housing, in accordance with some embodiments.
Figure 13:
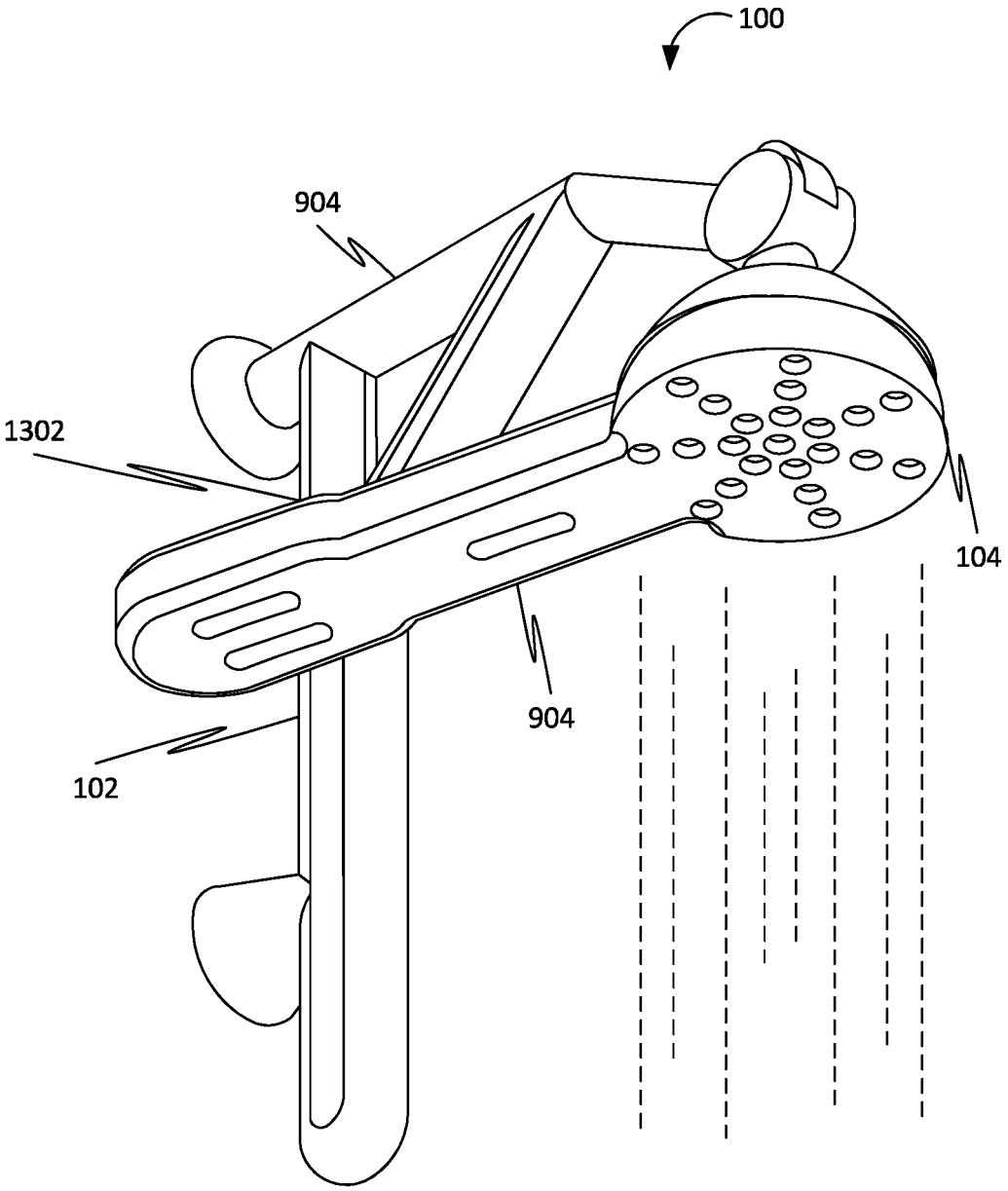
FIG. 13 is a bottom perspective view of the present invention, in accordance with some embodiments.

In an embodiment, the hand-held shower head 104 system 100 may be positioned to function as in a fixed rain shower head 104 orientation 1300, as can be seen in FIG. 12. As can be seen in FIG. 13, the hand-held shower head 104 system 100 may be positioned in a horizontal position, and may include a second magnet 1302 positioned on the lower portion 904 of the head 104 to allow the lower portion 904 to attach to the housing 102. In alternate embodiments of the present invention, the hand-held shower head 104 system 100 may comprise different designs and configurations and may be positioned in different positions and configurations to allow the user to experience different showering experiences. Further, the hand-held shower head 104 system 100 may be easily installed without having to change or modify the structure by removing an existing shower head 104 and connecting the one or more connectors 402 to the existing plumbing. The plurality of connectors 104 may be further secured to a surface, such as a wall of the shower. Once installed, the hand-held shower head 104 system 100 may be used as a traditional shower head 104, or as a hand-held shower head 104. A user may grab the lower portion 904 of the head 104 and may pull the head 104 away from the one or more receivers 406. The plurality of hoses 604 is then extended at the length desired by the user so the head 104 can be positioned around the user. The one or more receiver can further be rotated at different angles around the one or more joint, as can be seen in FIG. 6. The user can utilize the plurality of controls 1006 on the lower portion 904 of the head 104 to set the water flow at the user's preferred settings. Once the user is done using the head 104 of the hand-held shower head 104 system, the user can reposition the head 104 back into the one or more receiver of the arm 302 of the housing 102 or can let go of the head 104. The retracting mechanism 602 inside the lower portion 306 of the housing 102 will pull the plurality of hoses 604 back into the body 102 of the housing 102 which may pull back the head 104 so that the head 104 is connected to the receiver 406.

Although the invention has been explained in relation to its preferred embodiment, it is to be understood that many other possible modifications and variations can be made without departing from the spirit and scope of the invention.

What is claimed is:

1. A hand-held shower head system configured to dispense a fluid, the hand-held shower head system comprising:

a magnetic coupling mechanism;

a housing;

the housing being configured to be secured to a surface of a shower;

a shower head;

the shower head being detachably mounted on the housing;

a hose;

the hose being connected to the shower head, wherein a first opening of the hose is configured to be connected to a fluid supply line;

a retracting mechanism;

the retracting mechanism being coupled to the hose;

the shower head being able to be retracted back to the housing via the hose being pulled by the retracting mechanism;

the housing comprising an arm, an upper housing portion and a lower housing portion;

the upper housing portion being connected in between the arm and the lower housing portion;

the upper housing portion comprising an upper connector configured to connect the housing to an existing plumbing of the shower;

the lower housing portion comprising a lower connector configured to secure the housing to the surface of the shower;

the retracting mechanism being accommodated within the upper housing portion and the lower housing portion;

the shower head comprising an upper head portion and a lower head portion;

the upper head portion and the lower head portion being connected with each other;

the upper head portion comprising a front and a back;

the front comprising a plurality of orifices;

the plurality of orifices being configured to dispense the fluid;

the back being detachably mounted to the arm via the magnetic coupling mechanism;

the magnetic coupling mechanism comprises a plurality of magnets;

the plurality of magnets being positioned on the back;

the back comprising an inlet;

the plurality of magnets being arranged in a circular pattern around the inlet;

the inlet being connected with a second opening of the hose;

the lower head portion comprising a handle and a control mechanism;

the handle being configured to be grabbed by a human hand;

the handle comprising a front surface;

the control mechanism being positioned on the front surface;

the control mechanism being configured to control at least one flow property of the fluid dispensed from the plurality of orifices; and the control mechanism comprising at least one of a mechanical control and an electrical control.

2. The hand-held shower head system of claim 1, wherein the plurality of hoses are configured to be connected to a wall pipe system.

3. The hand-held shower system of claim 1, wherein the arm comprises one or more receivers and one or more joints connected with each other, and the back is detachably mounted to the one or more receivers via the magnetic coupling mechanism.

4. The hand-held shower system of claim 1, wherein the hose is pulled into the upper housing portion and the lower housing portion by the retracting mechanism while the shower head is retracted back to the housing.

* * * * *